US010322857B2

(12) United States Patent
Carver et al.

(10) Patent No.: US 10,322,857 B2
(45) Date of Patent: Jun. 18, 2019

(54) CONTAINER ADAPTER LIDS

(71) Applicants: John Carver, Portland, OR (US); Kelley Carver, Portland, OR (US)

(72) Inventors: John Carver, Portland, OR (US); Kelley Carver, Portland, OR (US)

( * ) Notice: Subject to any disclaimer, the term of this patent is extended or adjusted under 35 U.S.C. 154(b) by 0 days.

(21) Appl. No.: 15/844,943

(22) Filed: Dec. 18, 2017

(65) Prior Publication Data

US 2018/0105334 A1 Apr. 19, 2018

(51) Int. Cl.

| | |
|---|---|
| ***B65D 51/02*** | (2006.01) |
| ***B65D 47/12*** | (2006.01) |
| ***B65D 47/20*** | (2006.01) |
| ***B65D 51/28*** | (2006.01) |
| ***B65D 53/02*** | (2006.01) |

(52) U.S. Cl.

CPC ..... *B65D 51/02* (2013.01); *B65D 47/123* (2013.01); *B65D 47/2018* (2013.01); *B65D 51/2821* (2013.01); *B65D 53/02* (2013.01); *B65D 2539/001* (2013.01); *B65D 2539/003* (2013.01); *B65D 2547/063* (2013.01)

(58) Field of Classification Search

CPC ..... B65D 2539/001; B65D 2539/003; B65D 2547/066

USPC ..... 215/270, 11.2–11.4

See application file for complete search history.

(56) References Cited

U.S. PATENT DOCUMENTS

| | | | | |
|---|---|---|---|---|
| 4,823,969 | A * | 4/1989 | Caldwell | B67C 9/00 215/260 |
| 5,240,131 | A * | 8/1993 | Keller | B65D 79/005 215/230 |
| 5,944,212 | A * | 8/1999 | Chang | B65D 81/2038 215/228 |
| 8,636,166 | B2 | 1/2014 | Lane | |
| 9,771,189 | B2 | 9/2017 | Miksovsky et al. | |
| 2013/0248536 | A1 | 9/2013 | Prum et al. | |
| 2014/0151376 | A1 | 6/2014 | Sprague et al. | |
| 2017/0320640 | A1 | 11/2017 | Steinmann | |
| 2018/0105334 | A1 | 4/2018 | Carber et al. | |

* cited by examiner

*Primary Examiner* — Anthony D Stashick
*Assistant Examiner* — Raven Collins
(74) *Attorney, Agent, or Firm* — Mohr Intellectual Property Law Solutions, PC

(57) ABSTRACT

Apparatuses and methods of operating the same are described. A container lid adapter including a gasket, an adapter lid, and a container band. The gasket may be shaped to attach to a rim of a container to form a seal between the rim and the gasket. The adapter lid may include an opening shaped to receive an adapter. The container band may be shaped to attach the gasket and the adapter lid to the rim of the container.

21 Claims, 9 Drawing Sheets

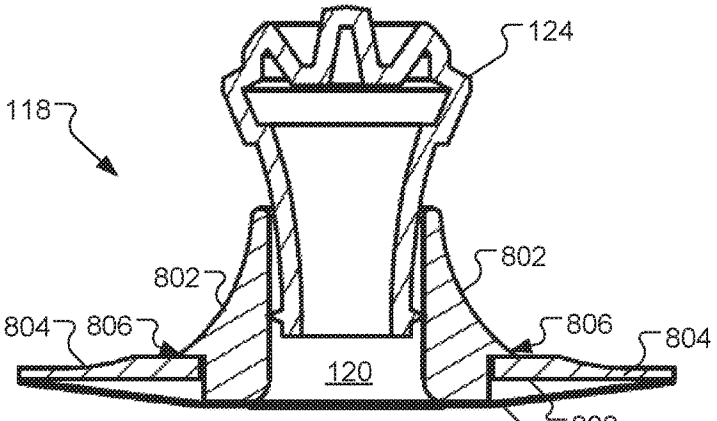
FIG. 8A
FIG. 8B
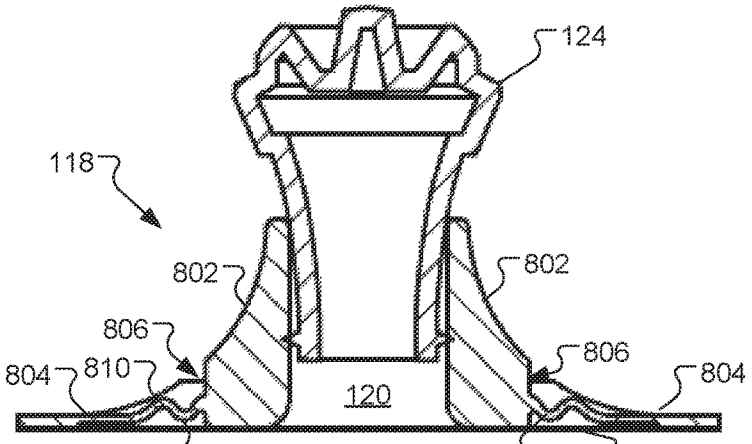
FIG. 8C
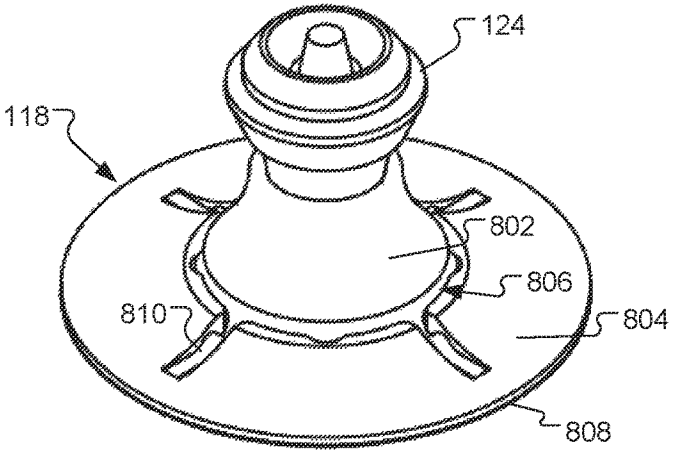
FIG. 8D

CONTAINER ADAPTER LIDS

BACKGROUND

Jars may be used to store a number of assorted items. For example, decorative jars such as Mason jars, apothecary jars, and jelly jars may be used to store objects. The objects may include food, liquids, lights, miscellaneous objects, and so forth. An individual may choose different jars to store objects bases on the size and shape of the jar, the material of the jar, the aesthetic nature of the jar, the functionality of the jar, and so forth.

SUMMARY

A container lid adapter including a gasket, an adapter lid, and a container band. The gasket may be shaped to attach to a rim of a container to form a seal between the rim and the gasket. The adapter lid may include an opening shaped to receive an adapter or accessory. The container band may be shaped to attach the gasket and the adapter lid to the rim of the container.

BRIEF DESCRIPTION OF THE DRAWINGS

The present description will be understood more fully from the detailed description given below and from the accompanying drawings of various embodiments of the present embodiment, which, however, should not be taken to limit the present embodiment to the specific embodiments, but are for explanation and understanding only.

FIG. 8A shows a side cross-sectional view of the adapter lid with a pressure indicator, according to an embodiment.

FIG. 8B shows a side cross-sectional view of the adapter lid with the pressure indicator 806 in a depressed position, according to an embodiment.

FIG. 8C shows a side cross-sectional view of the adapter lid with the pressure indicator 806 that includes an exertion device, according to an embodiment.

FIG. 8D shows a side view of the adapter lid with the pressure indicator that includes and exertion device, according to an embodiment.

DETAILED DESCRIPTION

Figure 1A:
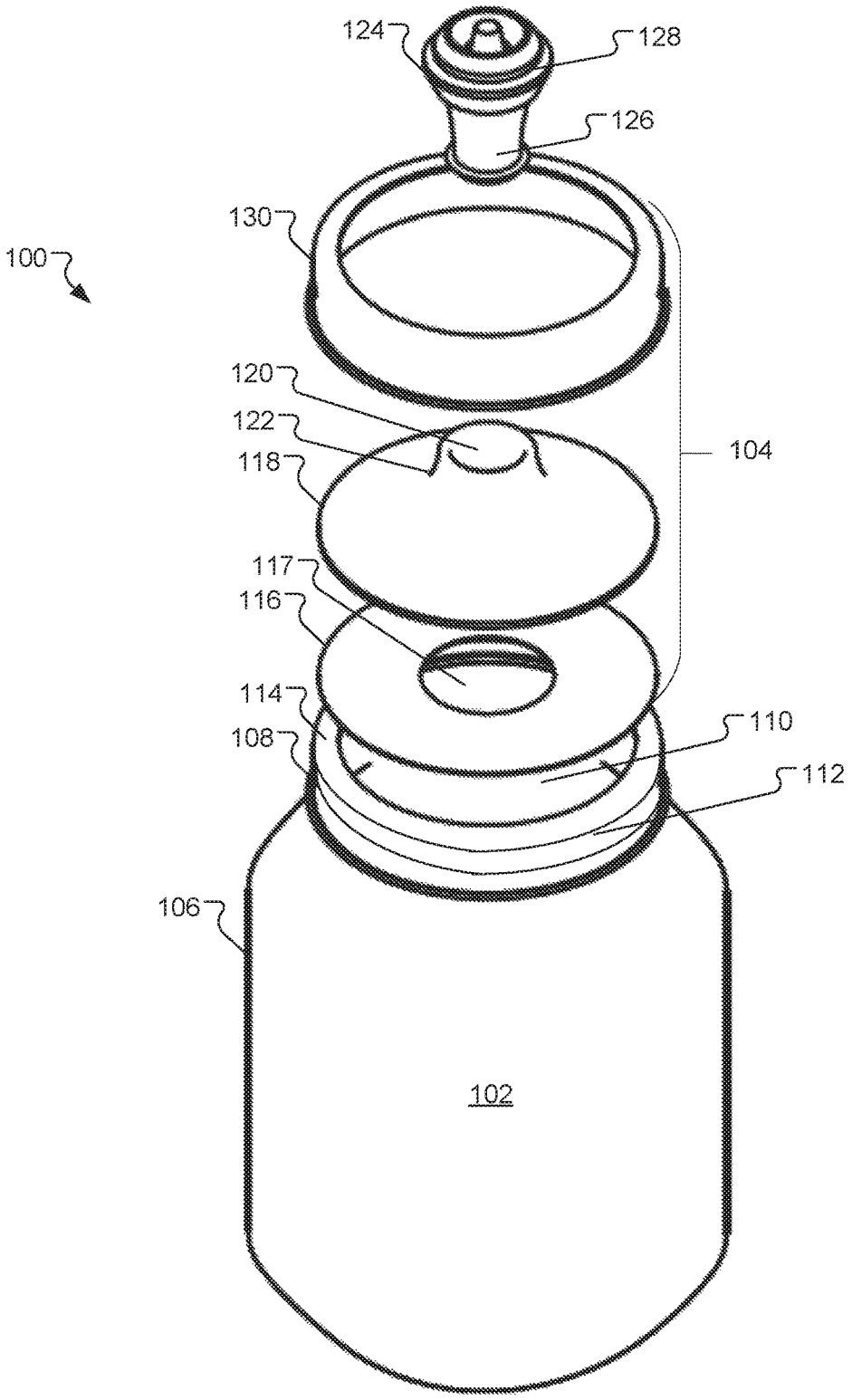
FIG. 1A shows a container system with a container and container lid adapter, according to an embodiment.

The disclosed container adapter lids will become better understood through a review of the following detailed description in conjunction with the figures. The detailed description and figures provide merely examples of the various embodiments described herein. Those skilled in the art will understand that the disclosed examples may be varied, modified, and altered without departing from the scope of the embodiments described herein. Many variations are contemplated for different applications and design considerations; however, for the sake of brevity, each and every contemplated variation is not individually described in the following detailed description.

Throughout the following detailed description, examples of various container adapter lids are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Individuals may use containers to store, display, and organize a variety of objects. The containers may vary in size, shape, material, functionality, and so forth. For example, the jars may be used to store a number of assorted items. Decorative jars, such as Mason jars, apothecary jars, and jelly jars may be used to store, display, and organize objects. The objects may include food, liquids, cannabis, medication, lights, miscellaneous objects, and so forth.

Individuals may use different containers to store objects based on the aesthetic nature of the container. For example, the decorative elements of Mason jars make them popular ornamental motifs. Objects may be stored in Mason jars to highlight an aesthetic nature of the objects and the Mason jar. Lights may be positioned in, or adjacent to, the jars to illuminate the contents of the jars in an aesthetically-pleasing manner.

The Mason jars may also have functional advantages for storing objects. For example, conventional Mason jars are transparent or translucent. When objects are stored in the Mason jars, an individual may be able to see the objects within the Mason jar to determine an amount of the object left in the Mason jar or a status of the object in the Mason jar without opening the Mason jar. For example, when Mason jars are used to store a food or a liquid, an individual may visually inspect the food or the liquid within the Mason jars to determine an amount of food within the Mason jar and whether the food or liquid appears to be fresh and edible. Mason jars may also provide a food safe container to foods and liquids, as the glass material may be non-porous and the material of the Mason jars may not leach onto the food or liquid. The Mason jars may also repel odors so that the Mason jars may be reused to store different foods or liquids without contaminating the foods or the liquids with the previous objects stored in the Mason jars.

While containers, such as Mason jars, may provide several benefits for storing, displaying, and organizing objects, conventional Mason jar lids may limit the type of objects that are stored in the Mason jars. For example, storing a food or a liquid in a Mason jar long term may be difficult as sealing a lid to a Mason jar may be a prolonged and arduous process of heating and cooling the Mason jar with the lid. Additionally, conventional lids must be removed to access objects stored in the Mason jars. When the lid is removed, the objects stored in the Mason jar may be exposed to a large amount of air, which may spoil or ruin the objects over a period of time. The conventional Mason jar lids may also be a hindrance when removing the objects, such as food or liquid, from the Mason jars and the relatively large mouth of the Mason jars may make it difficult for an individual to remove the food or the liquid from the Mason jars. For example, the relatively large mouth of the Mason jar may make it difficult to pour the food or the liquid from the Mason jars.

The embodiments described herein may address the above-noted deficiencies by providing a container jar lid. The container jar lid may include a gasket and an adapter lid. The gasket may form a seal between a container and the adapter lid. The adapter lid may include an opening to receive one or more lid accessories. The container adapter lid may include the container band that may fasten the gasket and the adapter lid to the container.

FIG. 1A shows a container system 100 with a container 102 and container lid adapter 104, according to an embodiment. The container 102 may include a body 106, a neck 108, and an opening 110. The body 106 of the container 102 may include a cavity to store an object. In one example, the object may be food, food ingredients, dried food, food storage items, and so forth. In another example, the object may be a liquid, such as wine, beer, soda, water, vinegar, olive oil, vegetable oil, and so forth. In another example, the object may be a toy, buttons, keys, lights, and so forth. The neck 108 may connect to a top portion of the body 106. For example, the body 106 may be a cylindrical body with a relatively flat base. The cylindrical body may extend from the base and a top portion of the body 106. The neck 108 may connect to the top portion of the body 106. In one example, the body 106 may taper inward toward the neck 108. In one embodiment, the neck 108 may include threads or grooves 112 for a lid or the container lid adapter 104 to connect to. In another embodiment, the neck 108 may include a hinge for the lid or the container lid adapter 104 to connect to. The opening 110 of the container 102 may provide an opening for an object to be placed into the cavity of the body 106 or removed from the cavity of the body 106. The neck 108 may include a rim 114 at a top portion of the neck that extends around the opening 110.

In one embodiment, the container 102 may be a mason jar. In another embodiment, the container may be an apothecary jar, a jelly jar, a cup, or a bowl. The container 102 may be glass, plastic, rubber, ceramic, polyurethane, and so forth. In one example, the container 102 may be cylinder shaped. In another example, the container 102 may be square shaped, rectangular shaped, or another polygon shape. In another example, the neck 108 and the rim 114 may be cylinder shaped. In another example, the neck 108 and rim 114 may be square shaped, rectangular shaped, or another polygon shape.

The container lid adapter 104 may include a gasket 116, an adapter lid 118, a container band 130, and an adapter 124. The gasket 116 may be shaped to attach to the rim 114 of the container 102. For example, the rim 114 and the gasket 116 may be circle shaped and a diameter of the gasket 116 may be equal to or greater to a diameter of the rim 114. The gasket 116 may be placed on a top surface of the rim 114 to form a seal between the rim 114 and the gasket 116. In one embodiment, the gasket 116 may include a hole 117. The hole 117 may be less than the diameter of the rim 114. In one example, the hole 117 may be located at approximately a center of the gasket 116 or at the center of the gasket 116. The hole 117 may provide an opening for objects to pass through to be placed in the cavity of the body 106 or be retrieved from the body 106.

The gasket 116 and/or the adapter lid 119 may be circular shaped, oval shaped, square shaped, rectangular shaped, or another polygon shape. The adapter lid 118 may be shaped to attach to the gasket 116. For example, the adapter lid 118 may be placed on top of the gasket 116. In one embodiment, the adapter lid 118 may be shaped to attach to the gasket 116. In another embodiment, the adapter lid 118 may also rest with the gasket 116 on the rim 114. For example, the adapter lid 118 and the gasket 116 may be circle shaped. In one embodiment, a diameter of the adapter lid 118 may be equal to or greater to a diameter of the gasket 116. In another embodiment, a diameter of the adapter lid 118 may be equal to or greater to a diameter of the rim 114.

In one example, a bottom surface of the gasket 116 may be placed on the top surface of the rim 114. In another example, a bottom surface of the adapter lid 118 may be placed on a top surface of the gasket 116 to form a seal between the adapter lid 118 and the gasket 116. The adapter lid 118 may include an opening 120. The opening 120 may be less than the diameter of the rim 114. The opening 120 may provide an opening or channel for objects to pass through for an individual to place in the cavity of the body 106 or retrieve from the body 106. In one embodiment, the opening 120 may be located at the center of the adapter lid 118 or approximate to the center of the adapter lid 118. In another embodiment, the opening may be located off center of the adapter lid 118.

The adapter lid 118 may include an opening wall 122 formed around at least a first portion of the opening 120. In one embodiment, the opening wall 122 may extend from a top surface of the adapter lid 118. In one example, the opening wall 122 may form a dome or cone shaped wall around the opening 120. In another example, the opening wall 122 may for a cylinder around the opening 120. In another example, the opening wall 122 may be tapered at an angle at from an outer portion or edge of the top surface of the adapter lid 118 to the opening 120 of the adapter lid 118.

The opening 120 and the opening wall 122 may be shaped to receive an adapter 124. For example, a diameter of the opening 120 may be approximately the same as a diameter of at least a bottom portion of the adapter 124. In one example, the diameter may be within the range of approximately 13.5 millimeters (mm) to 18.5 mm. For example, the adapter 124 may include a bottom portion 126 and a top portion 128. In one embodiment, a diameter or size of the bottom portion 126 may be approximately the same diameter or size as the top portion 128. In another embodiment, a diameter or size of bottom portion 126 may be less than a diameter or size of the top portion 128. When the adapter is inserted into the opening 120, the bottom portion may be inserted into the opening 120. The opening wall 122 may encircle or circumscribe at least part of the sides of the adapter 124 to hold the adapter 124 in place within the opening 120. The adapter 124 may be a bottle stopper, a liquid pourer, a wine pourer, a wine aerator, a stopper, a vacuum seal attachment, a fermentation spout, a one way valve, a metered pour spout, and so forth.

The container band 130 may be a ring or band that may attach to the neck 108 of the container 102. The container band 130 (also referred to as a screw band) may be a flat, thin strip or loop of material that may be shaped to fit around the gasket 116 and the adapter lid 118. For example, the container band 130 may include threads that may screw onto the threads 112 of the neck 108. A diameter of the container band 130 may be greater than a diameter of the gasket 116 and the adapter lid 118 to fit over top of the gasket 116 and the adapter lid 118 and attach to the neck 108 of the container 102. For example, the container band 130 may fit over top of the gasket 116 and the adapter lid 118 and screw onto the threads 112 of the neck 108 of the container 102.

As the container band 130 is screwed onto the threads 112, the container band 130 may compress the gasket 116 and the adapter lid 118 to form a seal between the rim 114, the gasket 116, the adapter lid 118, and/or the container band 130. For example, the container band 130 may include threads along an inner perimeter of the container band 130 and the container 102 may include threads along an outer perimeter of the neck 108. When the container band 130 is screwed onto the threads 112, the container band 130 may compress an outer perimeter of the gasket 116 and the adapter lid 118 to seal against the rim 114 of the container 102. In another embodiment, the gasket 116 and the adapter lid 118 may be compressed against the rim 114 by downward pressure from a vacuum seal. For example, the adapter 124 may be a vacuum seal adapter that removes the air from the container 102. As the air is removed from the container 102, the lack of air may create a vacuum that may seal, such as a hermetic seal, the gasket 116 and adapter lid 118 against the rim 114.

In one embodiment, the container band 130 may connect to the neck 108 of the container 102 by a friction fit, a compression fit, epoxy, a fastener, and so forth. In one example, the container band 130 may include threads to connect with the threads 112 of the container 102.

Figure 1B:
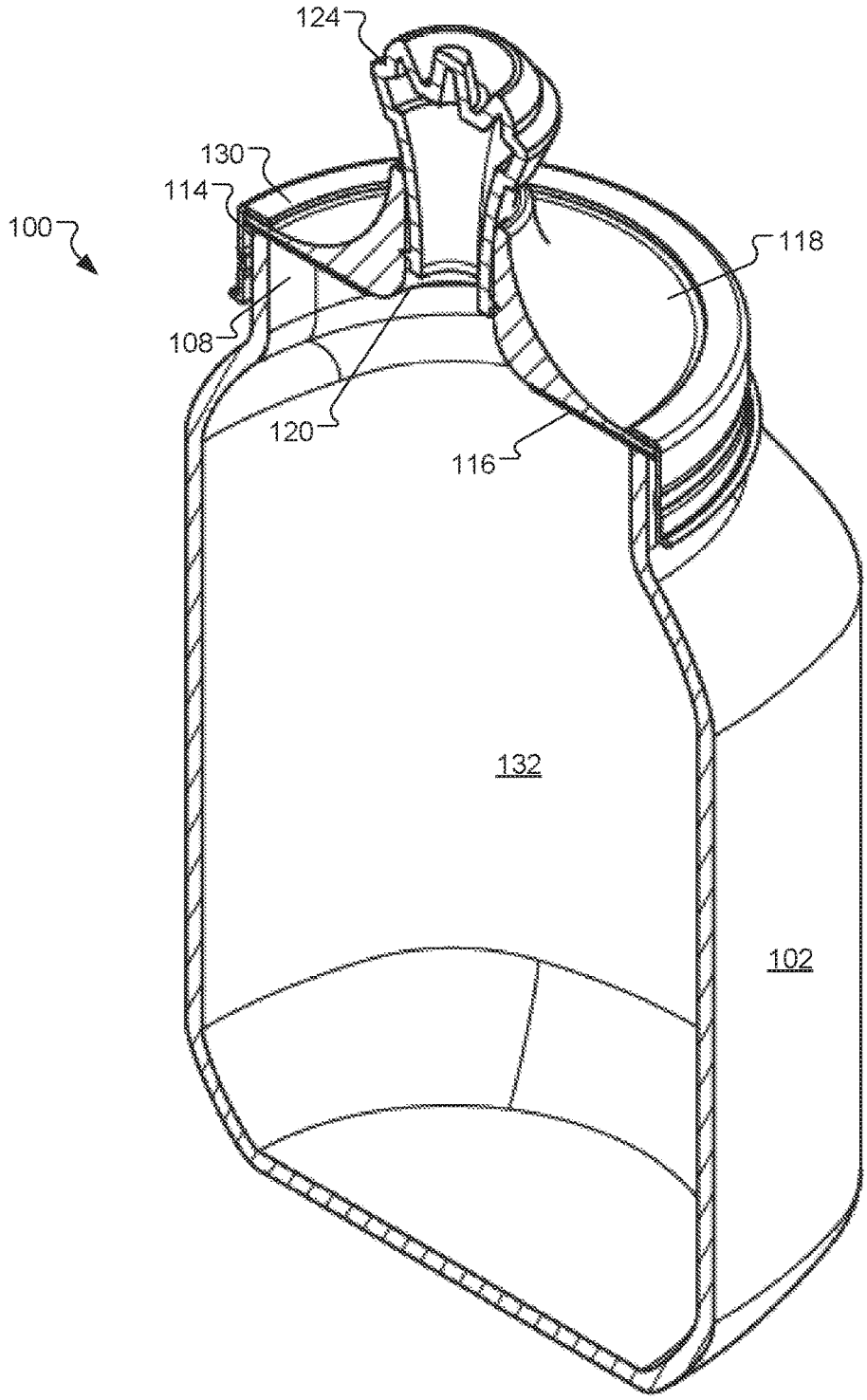
FIG. 1B shows a side view of a cross-section of the container system in FIG. 1A, according to an embodiment.

FIG. 1B shows a side view of a cross-section of the container system 100 in FIG. 1A, according to an embodiment. Some of the features in FIG. 1B are the same or similar to some of the features in FIG. 1A as noted by the same reference numbers, unless expressly described otherwise. FIG. 1B shows an assembled view of the container system 100. The container band 130 may be attached to the neck 108 of the container 102 to seal the gasket 116 and the adapter lid 118 to the rim 114 of the container 102. The adapter 124 may be inserted into at least part of the opening 120 of the adapter lid 118. When assembled, the container 102, the container lid adapter 104, and the adapter 124 may form an enclosed cavity 132 to store objects. When the adapter 124 is removed from the opening 120, the opening 120 may provide a channel to put objects into the cavity 132 or remove objects from the cavity 132. When the adapter 124 is placed back into the opening 120, the cavity may again be sealed and enclosed.

Figure 2C:
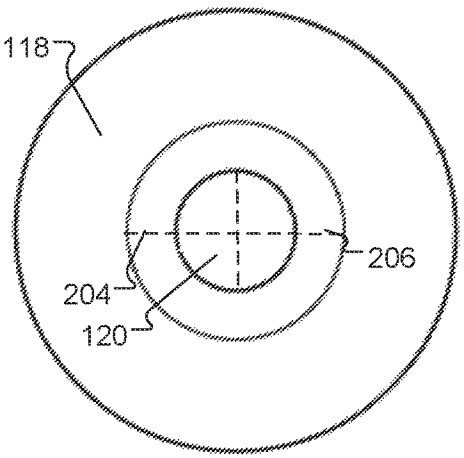
FIG. 2C shows a top view of the adapter lid in FIG. 1A, according to an embodiment.
Figure 2B:
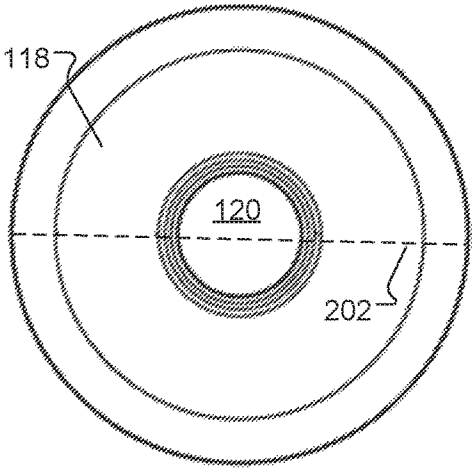
FIG. 2B shows a top view of the adapter lid in FIG. 1A, according to an embodiment.
Figure 2A:
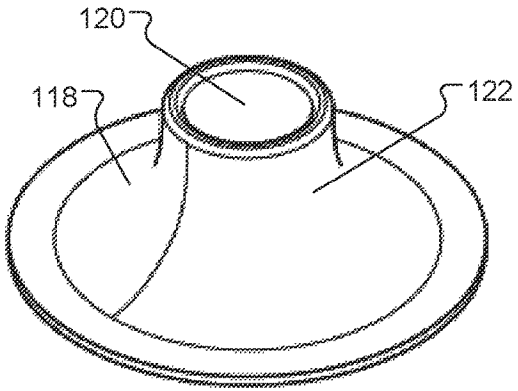
FIG. 2A shows a side perspective view of the adapter lid in FIG. 1A, according to an embodiment.

FIG. 2A shows a side perspective view of the adapter lid 118 in FIG. 1A, according to an embodiment. Some of the features in FIG. 2A are the same or similar to some of the features in FIGS. 1A-1B as noted by the same reference numbers, unless expressly described otherwise. As discussed above, the opening wall 122 may extend from a top surface of the adapter lid 118. The opening wall 122 may extend around the opening 120 to form a dome or a cone. For example, the edges of the opening 120 may form a base for the opening wall 122 and the opening wall 122 may be a wall that tapers from the base to a point above the surface of the adapter lid 118.

FIG. 2B shows a top view of the adapter lid 118 in FIG. 1A, according to an embodiment. Some of the features in FIG. 2B are the same or similar to some of the features in FIGS. 1A-1B and 2A as noted by the same reference numbers, unless expressly described otherwise. In one example, the adapter lid 118 may be circularly shaped. In another embodiment, the adapter lid 118 may have a diameter 202 of approximately 70 millimeters (mm) in diameter. For example, the diameter 202 may be approximately that same diameter as the opening of a regular-mouth Mason jar. In another embodiment, the adapter lid 118 may have a diameter 202 of approximately 86 mm in diameter. For example, the diameter 202 may be approximately that same diameter as the opening of a wide-mouth Mason jar. The diameter and/or shape of the adapter lid 118 are not intended to be limiting. For example, the diameter and shape of the adapter lid 118 may vary based on size and shape of an opening of a container.

FIG. 2C shows a top view of the adapter lid 118 in FIG. 1A, according to an embodiment. Some of the features in FIG. 2C are the same or similar to some of the features in FIGS. 1A-1B and 2A-2B as noted by the same reference numbers, unless expressly described otherwise. In one example, the opening 120 of the adapter lid 118 may be circularly shaped. The opening wall 122 may be tapered. For example, the opening wall 122 may extend from a bottom surface of the adapter lid 118 with a base diameter 204 to a point above the surface of the adapter lid 118 and have a tapered diameter 206 that is less than the base diameter 204. In one example, the base diameter 204 may be approximately 20 mm and the tapered diameter may be approximately 18.5 mm. The diameter and/or shape of the opening 120 or the opening wall 122 are not intended to be limiting. For example, the diameter and shape of the opening 120 or the opening wall 122 may vary based on a size and shape of an opening 120 of the container 102 or the adapter 124 in FIG. 1A.

Figure 2D:
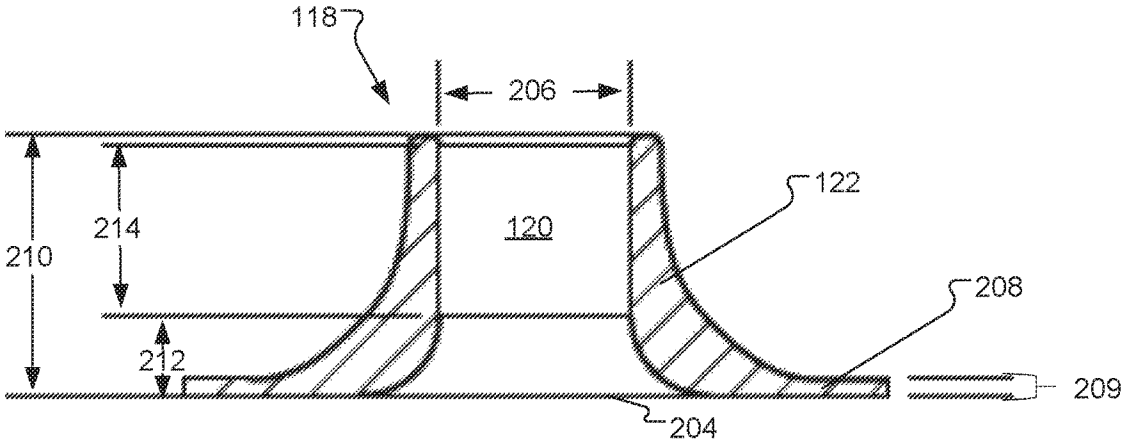
FIG. 2D shows a side cross-section view of the adapter lid in FIG. 1A, according to an embodiment.

FIG. 2D shows a side cross-section view of the adapter lid 118 in FIG. 1A, according to an embodiment. Some of the features in FIG. 2D are the same or similar to some of the features in FIGS. 1A-1B and 2A-2C as noted by the same reference numbers, unless expressly described otherwise. As discussed above, the opening 120 may be tapered. For example, the opening may extend from a bottom surface of the adapter lid 118 with a base diameter 204 to a point above the surface of the adapter lid 118 and have a tapered diameter 206 that is less than the base diameter 204. An overall height 210 of the opening 120 may be approximately 25 mm. A height 212 of the base section of the opening may be 8.5 mm. A height 214 of the tapered section of the opening may be 16.5 mm. The adapter lid 118 may include a portion 208 approximate to the opening wall 122 and an edge of the adapter lid 118. A thickness 209 of the portion 208 of the adapter lid 118 may be approximately 1.5 mm. The diameters, heights, thicknesses, and/or shape of the adapter lid 118 are not intended to be limiting. For example, the diameters, heights, thicknesses, and shape of the adapter lid 118 may vary based on size and shape of an opening of a container 102 or the adapter 124 in FIG. 1A.

Figure 3B:
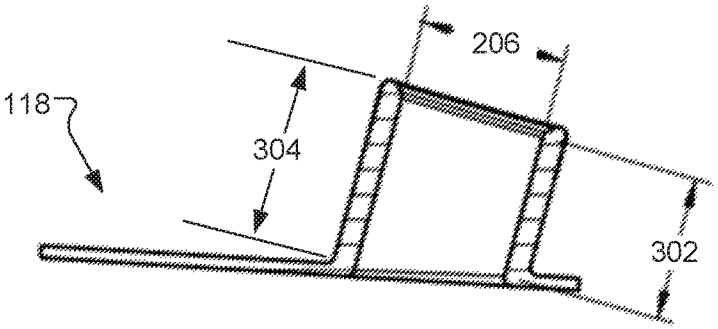
FIG. 3B shows a side cross-section view of the adapter lid in FIG. 1A where the opening and the opening wall are at an angle, according to an embodiment.
Figure 3A:
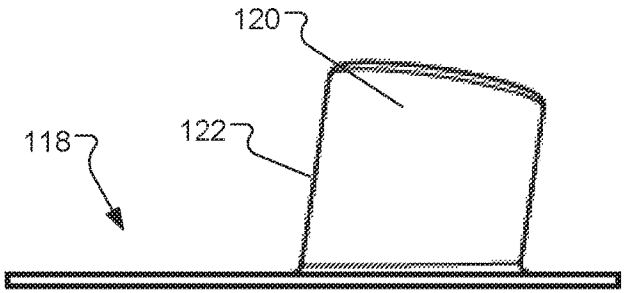
FIG. 3A shows a side view of the adapter lid in FIG. 1A where the opening and the opening wall are at an angle, according to an embodiment.

FIG. 3A shows a side view of the adapter lid 118 in FIG. 1A where the opening 120 and the opening wall 122 are at an angle, according to an embodiment. Some of the features in FIG. 3A are the same or similar to some of the features in FIGS. 1A-1B and 2A-2D as noted by the same reference numbers, unless expressly described otherwise. In one embodiment the opening 120 and the opening wall 122 may be slanted at an angle relative to the top surface of the adapter lid 118. In one example, the opening 120 and the opening wall 122 may be slanted at an angle between 1 degree and 89 degrees. In one example, the slanted opening 120 and opening wall 122 may provide structural integrity and support to the adapter lid 118. In another example, the slanted opening 120 and opening wall 122 may provide an opening a user may more easily insert an adapter. In another example, the adapter lid 118 may include multiple openings. In one embodiment, the adapter lid 118 may include a slanted opening and an upright or straight opening. In another embodiment, the adapter lid 118 may include multiple slanted openings. In another embodiment, the adapter lid 118 may include multiple upright or straight openings. The multiple openings may be located at different locations on the adapter lid 118. The amount of openings, location of the openings, and angle of the openings are not intended to be limiting. The amount of openings, location of the openings, and angle of the openings may vary based on the adapter 124 that the adapter lid 118 is configured to receive.

FIG. 3B shows a side cross-section view of the adapter lid 118 in FIG. 1A where the opening 120 and the opening wall 122 are at an angle, according to an embodiment. Some of the features in FIG. 3B are the same or similar to some of the features in FIGS. 1A-1B, 2A-2D, and 3A as noted by the same reference numbers, unless expressly described otherwise. As discussed above, the opening 120 and the opening wall 122 may be slanted at an angle relative to the top surface of the adapter lid 118. In one example, a height of a first side 302 of the slanted the opening 120 and the opening wall 122 may be approximately 18.3 mm. In another example, a height of a second side 304 of the slanted the opening 120 and the opening wall 122 may be approximately 19 mm. The heights of the first side 302 and the second side 304 of the opening 120 and the opening wall 122 are not intended to be limiting. For example, the heights of the first side 302 and the second side 304 of the opening wall 122 may vary based on size and shape of an opening of a container 102 or the adapter 124 in FIG. 1A.

Figure 3C:
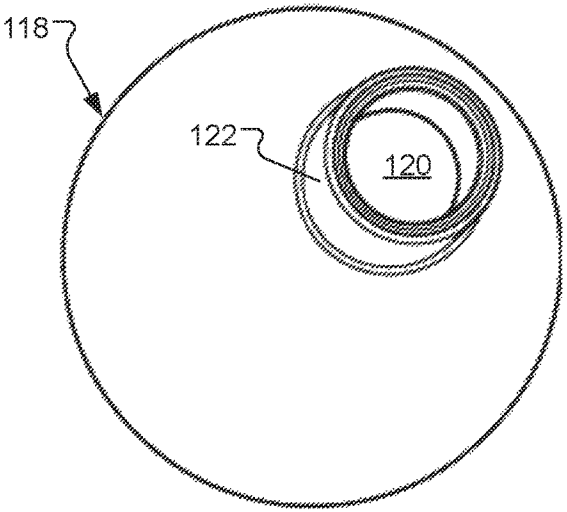
FIG. 3C shows a top perspective view of the adapter lid in FIG. 1A that is off-centered, according to an embodiment.

FIG. 3C shows a top perspective view of the adapter lid 118 in FIG. 1A that is off-centered, according to an embodiment. Some of the features in FIG. 3C are the same or similar to some of the features in FIGS. 1A-1B, 2A-2D, and 3A-3B as noted by the same reference numbers, unless expressly described otherwise. As discussed above, in one embodiment the opening 120 and the opening wall 122 may be located at approximately a center of the adapter lid 118. As shown in FIG. 3A, the opening 120 and the opening wall 122 may be located off-center of the center of the adapter lid 118. In one example, the opening 120 and the opening wall 122 may be located near an edge of the adapter lid 118. In another example, the opening 120 and the opening wall 122 may be located between a center and an edge of the adapter lid 118.

Figure 4:
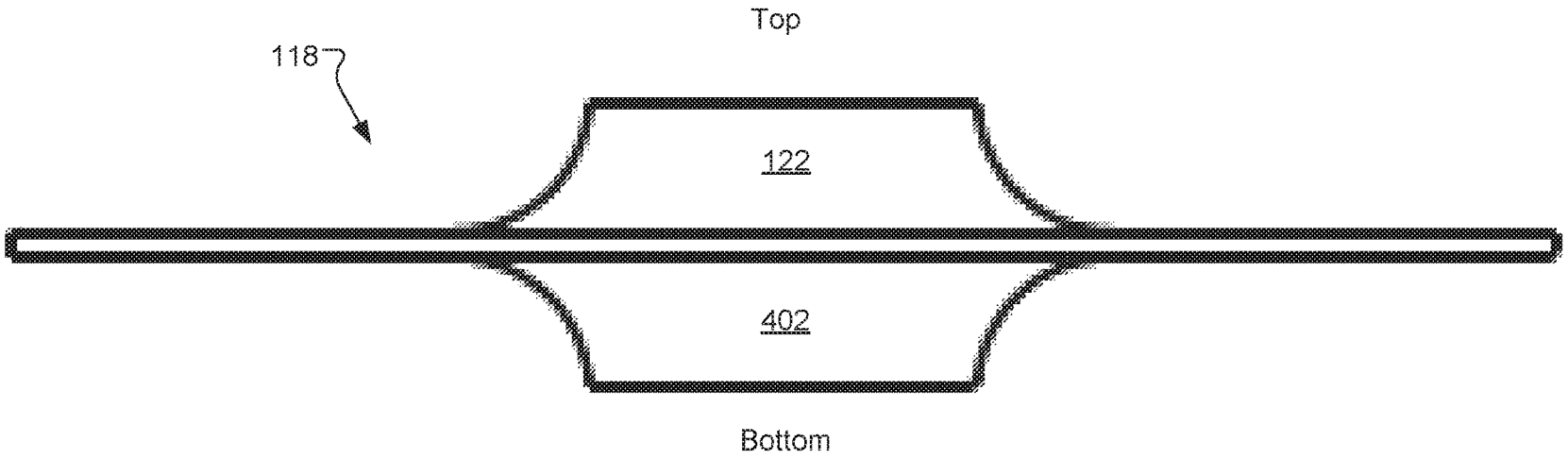
FIG. 4 shows a side view of the adapter lid in FIG. 1A with a second opening wall, according to an embodiment.

FIG. 4 shows a side view of the adapter lid 118 in FIG. 1A with a second opening wall 402, according to an embodiment. Some of the features in FIG. 4 are the same or similar to some of the features in FIGS. 1A-1B, 2A-2D, and 3A-3C as noted by the same reference numbers, unless expressly described otherwise. In one embodiment, the adapter lid 118 may include the first opening wall 122 at the top of the adapter lid 118 and the second opening wall 402 at a bottom of the adapter lid 118. In one embodiment, the first opening wall 122 and the second opening wall 402 may be substantially mirror images of each other, where the first opening wall 122 and the second opening wall 402 may have approximately the same height, diameter, and taper as each other. In another example, the first opening wall 122 may have a different height, diameter, or taper than the second opening wall 402. In one example, the second opening wall 402 may provide additional rigidity and structural support to the adapter lid 118.

Figure 5:
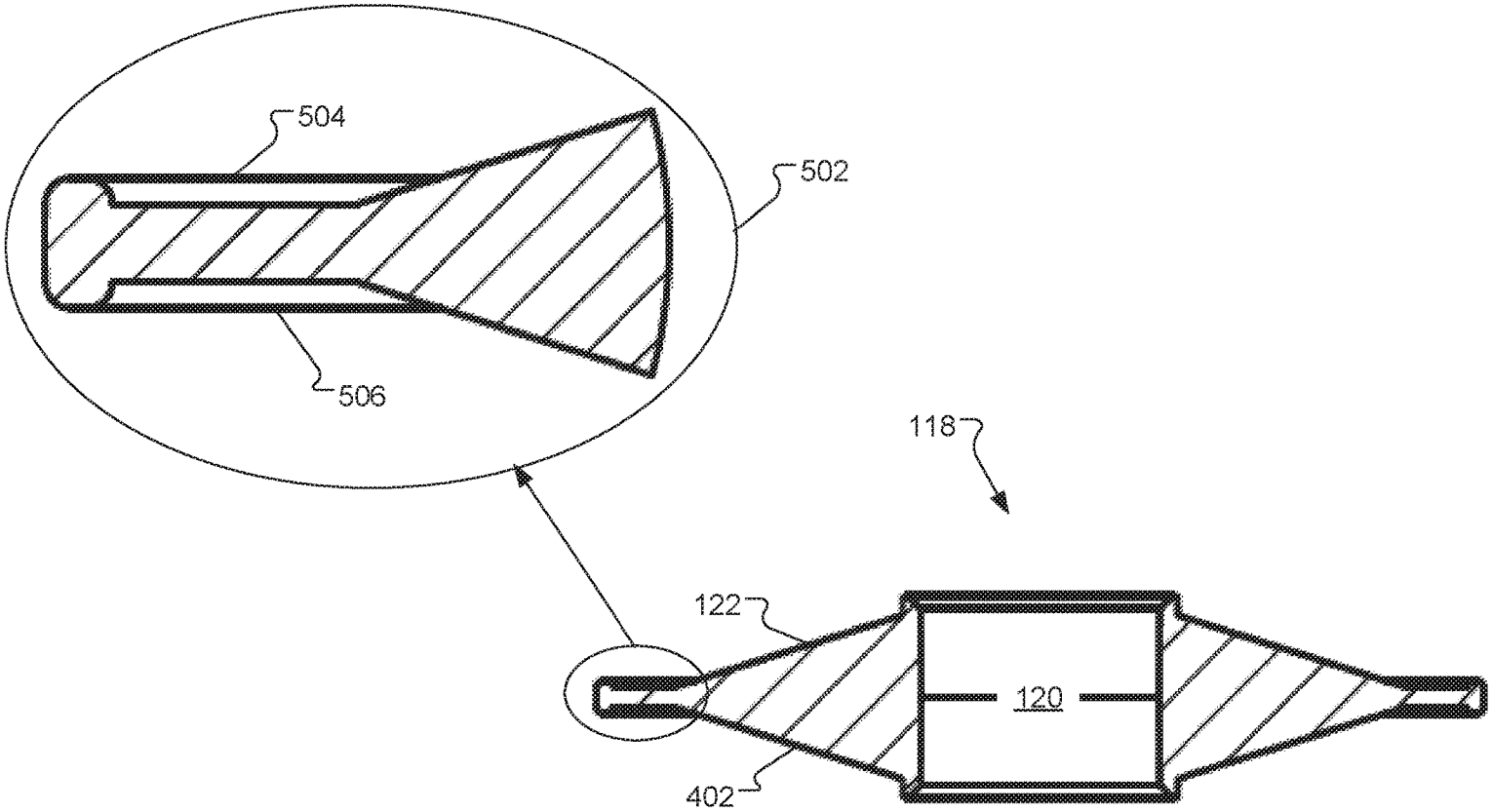
FIG. 5 shows a side cross-section view of the adapter lid in FIG. 4 with an integrated gasket, according to an embodiment.

FIG. 5 shows a side cross-section view of the adapter lid 118 in FIG. 4 with an outer edge 502 with an integrated gasket, according to an embodiment. Some of the features in FIG. 5 are the same or similar to some of the features in FIGS. 1A-1B, 2A-2D, 3A-3C, and 4 as noted by the same reference numbers, unless expressly described otherwise. In one embodiment, the gasket 116 and the adapter lid 118 may be separate pieces. In another embodiment, the gasket 116 may be integrated into the adapter lid 118. For example, the adapter lid 118 may include an outer edge 502 that extends along an outer perimeter of the adapter lid 118. The outer edge 502 may include gasket material that is integrated into the adapter lid 118. For example, the adapter lid 118 may be plastic, metal, or polyurethane and the gasket material may be rubber, silicone, thermoplastic elastomers (TPE), thermoplastic vulcanisates (TVP), or a soft plastic. In one embodiment, the gasket material may be integrated into a top surface 504 of the outer edge 502. The gasket material integrated into the top surface 504 of the outer edge 502 may provide a seal between the adapter lid 118 and the container band 130. In another embodiment, the gasket material may be integrated into a bottom surface 506 of the outer edge 502. The gasket material integrated into the bottom surface 506 of the outer edge 502 may provide a seal between the adapter lid 118 and the rim 114 of the container 102 in FIG. 1A. In another embodiment, the first opening wall 122 and/or the second opening wall 402 may extend from the edges of the opening 120 to the outer edge 502 of the adapter lid 118.

Figure 6B:
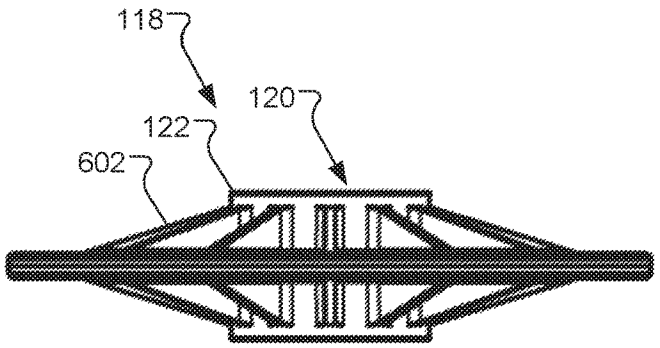
FIG. 6B shows a side view of the adapter lid in FIG. 1A with ribs, according to an embodiment.
Figure 6A:
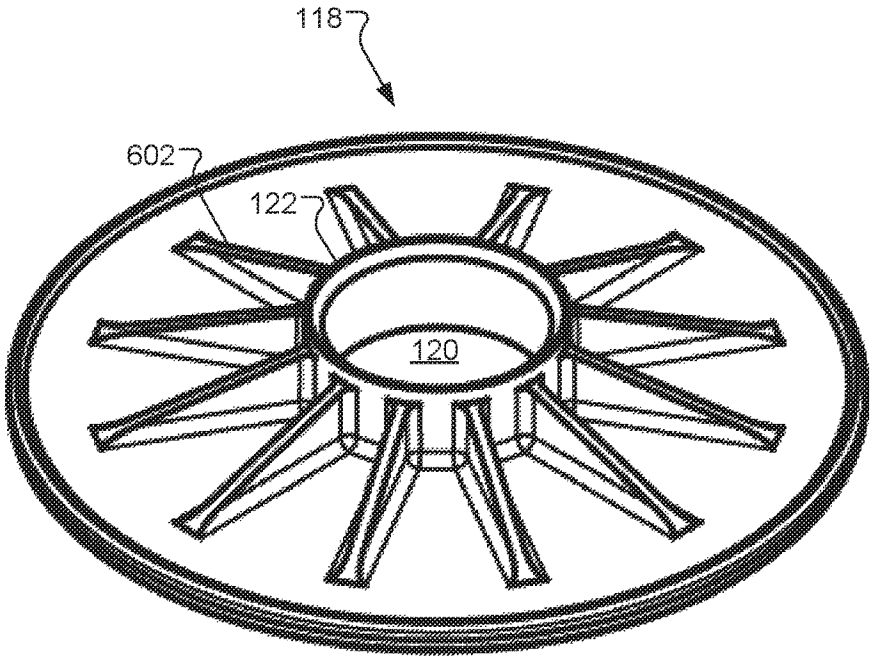
FIG. 6A shows a top perspective view of the adapter lid in FIG. 1A with ribs, according to an embodiment.

FIG. 6A shows a top perspective view of the adapter lid 118 in FIG. 1A with ribs 602, according to an embodiment. Some of the features in FIG. 6A are the same or similar to some of the features in FIGS. 1A-1B, 2A-2D, 3A-3C, 4, and 5 as noted by the same reference numbers, unless expressly described otherwise. The adapter lid 118 may include one or more ribs 602 that extend from the opening wall 122 toward an edge of the adapter lid 118. In one example, a rib 602 may extend all the way from the opening wall 122 to the edge of the adapter lid 118. In another example, the rib 602 may extend from the opening wall 122 to a location between the opening wall 122 and the edge of the adapter lid 118. The ribs 602 may be a relatively thin pieces of material that extends from the opening wall 122 toward an edge of the adapter lid 118 to provide structural support and rigidity to the adapter lid 118. For example, when the adapter 124 in FIG. 1A is inserted into the opening 120, the ribs 602 may provide structural support and integrity to the adapter lid 118 so that the adapter lid 118 may not deform or bend while the adapter 124 is inserted or once the adapter 124 has been inserted into the opening 120. In another example, when the adapter 124 is a vacuum seal attachment, vacuuming pressure may be applied to the adapter lid 118. The ribs 602 may increase the structural integrity and rigidity of the adapter lid 118 so that the adapter lid 118 does not indent or become deformed from the vacuum pressure. When the adapter lid 118 includes multiple ribs 602, the ribs 602 may be evenly spaced at defined intervals or in another pattern. The number and shape of the ribs is not intended to be limiting. For example, the adapter lid 118 may include a single rib or multiple ribs. In another example, the size and/or shape of the ribs 602 may vary.

FIG. 6B shows a side view of the adapter lid 118 in FIG. 1A with ribs 602, according to an embodiment. Some of the features in FIG. 6B are the same or similar to some of the features in FIGS. 1A-1B, 2A-2D, 3A-3C, 4, 5, and 6A as noted by the same reference numbers, unless expressly described otherwise. As discussed above, the adapter lid 118 may include one or more ribs 602 that extend from the opening wall 122 toward an edge of the adapter lid 118. In one embodiment, the ribs 602 may be located on top of the adapter lid 118 or a bottom of the adapter lid 118. In another example, the ribs 602 may be located on both the top and the bottom of the adapter lid 118. The number and shape of the ribs is not intended to be limiting. For example, the top or the bottom of the adapter lid 118 may include a single rib or multiple ribs. In another example, the top of the adapter lid 118 may include a first size and/or shape of the ribs 602 and the bottom of the adapter lid 118 may include a second size and/or shape of ribs 602.

Figure 7B:
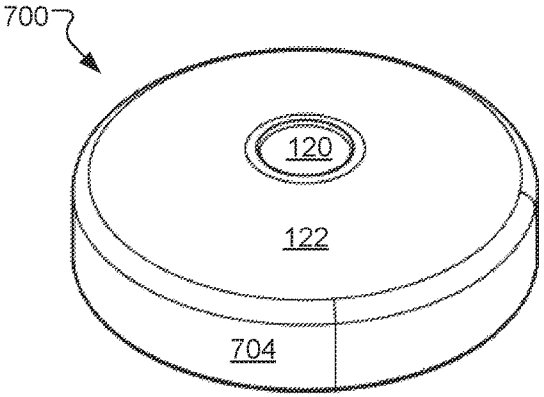
FIG. 7B shows a top perspective view of the lid in FIG. 7A, according to an embodiment.
Figure 7A:
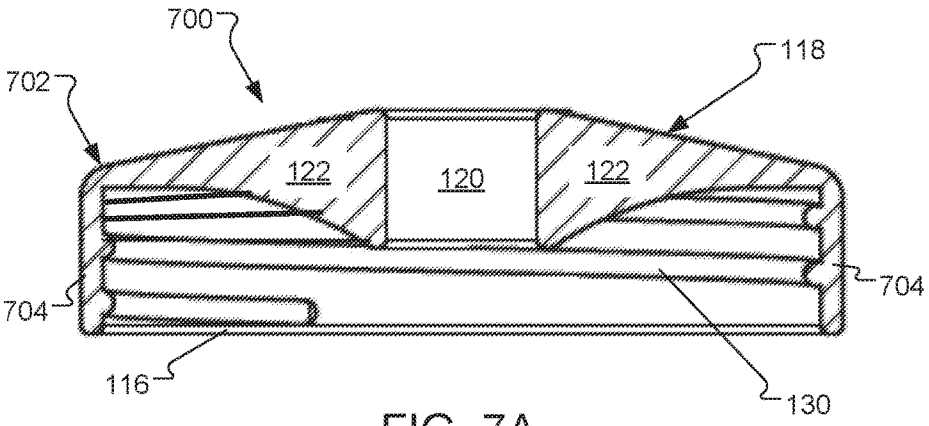
FIG. 7A shows a side cross-sectional view of the container lid adapter of FIG. 1A integrated into a lid, according to an embodiment.

FIG. 7A shows a side cross-sectional view of the container lid adapter 104 of FIG. 1A integrated into a lid 700, according to an embodiment. Some of the features in FIG. 7A are the same or similar to some of the features in FIGS. 1A-1B, 2A-2D, 3A-3C, 4A-4B, 5, and 6A-6B as noted by the same reference numbers, unless expressly described otherwise. The lid 700 may include a body 702 formed from a unified piece of material. In one embodiment, the gasket 116 may be integrated to a bottom of the body 702 to form a seal with the container 102 in FIG. 1A when the lid 700 is attached to the container 102. In another embodiment, the gasket 116 may be removably attached to the body 702. For example, the gasket 116 may be attached with an epoxy, an adhesive, or a friction fit within a channel of the body. When a user of the lid desires to replace the gasket, the user may remove the gasket 116 from the body and attach a new gasket 116. The container band 130 may be integrated into the body 702. For example, the container band 130 may include threads that are integrated into the body 702. The container band 120 may also include sidewalls 704 that form the sides of the body 702.

The lid 700 may be attached to the container 102 by threading the threads of the container band 130 onto the threads 112 of the container system 100 in FIG. 1A. The adapter lid 118 may be integrated into a top of the body 702. For example, the opening 120 may provide an opening from a top of the body 702 to a bottom of the body 702. The opening wall 122 may form around the opening 120 at the top of the body 702 to provide support to the body 702 and the opening 120. The opening 120 may receive the adapter 124, as discussed above. The opening wall 122 may be connected to the sidewalls 704. The size and shape of the lid 700 is not intended to be limiting. For example, the size of the lid 700 may vary based on a size of a neck 108 of the container 102 in FIG. 1A.

FIG. 7B shows a top perspective view of the lid 700 in FIG. 7A, according to an embodiment. Some of the features in FIG. 7B are the same or similar to some of the features in FIGS. 1A-1B, 2A-2D, 3A-3C, 4, 5, 6A-6B, and 7A as noted by the same reference numbers, unless expressly described otherwise. In one embodiment, the lid 700 may be cylinder shaped. For example, the sidewalls 704 may be cylinder sidewalls that extend around a circumference of the lid 700. The opening wall 122 may extend along the top of the lid 700 and attach to sidewalls 704 to form a top and side of the lid 700.

Figure 7C:
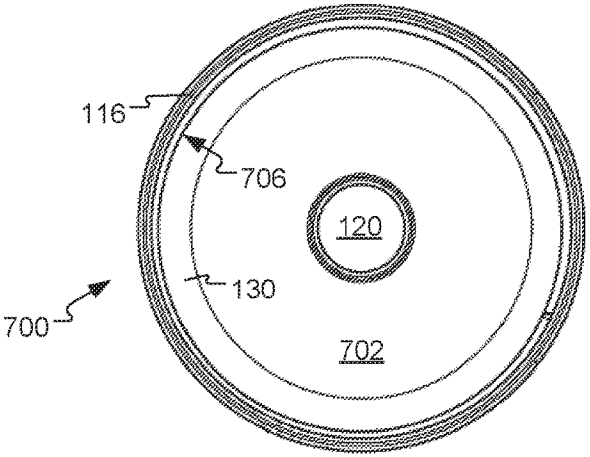
FIG. 7C shows a bottom view of lid in FIG. 7A, according to an embodiment.

FIG. 7C shows a bottom view of lid 700 in FIG. 7A, according to an embodiment. Some of the features in FIG. 7B are the same or similar to some of the features in FIGS. 1A-1B, 2A-2D, 3A-3C, 4, 5, 6A-6B, and 7A-7B as noted by the same reference numbers, unless expressly described otherwise. In one embodiment, the gasket 116 may run along a channel or indent 706 that runs along a bottom outer edge of the body 702 of the lid 700. The gasket 116 may have approximately the same diameter as the rim 114 or the neck 108 of the container 102 in FIG. 1A. The opening 120 may extend from the top of the body 702 to the bottom of the body 702. The container band 130 may be located within the circumference of the gasket 116.

FIG. 8A shows a side cross-sectional view of the adapter lid 118 with a pressure indicator 806, according to an embodiment. Some of the features in FIG. 8A are the same or similar to some of the features in FIGS. 1A-1B, 2A-2D, 3A-3C, 4, 5, 6A-6B, and 7A-7C as noted by the same reference numbers, unless expressly described otherwise. The adapter lid 118 may include the opening 120 with an opening wall 802 and a support wall 804. The opening wall 802 may circumscribe the opening 120 and be formed to receive the adapter 124. The support wall 804 may be approximate the opening wall 802 and provide additional support to the opening 120 to receive the adapter 124. In one embodiment, the opening wall 802 and the support wall 804 may be separated by the pressure indicator 806.

In one example, the pressure indicator 806 may be a gap between the opening wall 802 and the support wall 804 and a portion of the opening wall 802. The portion of the opening wall 802 may be colored to provide a visual indicator as discussed below. The opening wall 802 may slide up and down along the gap as pressure is applied to the adapter lid 118. For example, when an amount of pressure applied to the adapter lid 118 is below a threshold amount, the opening wall 802 may be in a popped-up position where a bottom of the opening wall 802 is approximately flush with a bottom 808 of the support wall 804. When the opening wall 802 may be in a popped up position, there may be a space between a portion of the opening wall 802 and a portion of the support wall 804. The space may show a visual indicator, such as a colored portion of the opening wall 802 that indicates that there is no pressure seal between the adapter lid 118 and a container. In one example, the adapter 124 may be a vacuum seal attachment that may be connected to the adapter lid 118. When a vacuum seal fails or the vacuum seal is not formed, the pressure indicator 806 may be in the popped-up position to indicate that there is not a vacuum seal between the adapter lid 118 and the container.

FIG. 8B shows a side cross-sectional view of the adapter lid 118 with the pressure indicator 806 in a depressed position, according to an embodiment. Some of the features in FIG. 8B are the same or similar to some of the features in FIGS. 1A-1B, 2A-2D, 3A-3C, 4, 5, 6A-6B, 7A-7C, and 8A as noted by the same reference numbers, unless expressly described otherwise. As discussed above, the opening wall 802 may slide up and down along the gap as pressure is applied to the adapter lid 118. When an amount of pressure applied to the adapter lid 118 exceeds a threshold amount, the opening wall 802 may be in a depressed position where a bottom of the opening wall 802 depresses below a bottom 808 of the support wall 804. When the opening wall 802 in the depressed position there may be no space or a minimal space between a portion of the opening wall 802 and a portion of the support wall 804. When the space is not visible, the visual indicator indicates that there is a pressure seal between the adapter lid 118 and a container. In one example, the adapter 124 may be a vacuum seal attachment that may be connected to the adapter lid 118.

When a vacuum seal vacuum seal is formed between the adapter lid 118 and the container, the pressure indicator 806 may be in the depressed position to indicate that there is a vacuum seal between the adapter lid 118 and the container. When the adapter lid 118 is in the depressed position, the bottom of the opening wall 802 and/or the support wall 804 may be flexed or pulled downward. As the bottom of the opening wall 802 and/or the support wall 804 may be flexed or pulled downward, a rigidity or structure of the adapter lid 118 may apply upward pressure on the opening wall 802 and/or the support wall 804. When the amount of vacuum pressure on the opening wall 802 and/or the support wall 804 is below the threshold amount, the upward pressure on the opening wall 802 and/or the support wall 804 may cause the opening wall 802 and/or the support wall 804 to pop up and the opening wall 802 to be in the popped-up position.

FIG. 8C shows a side cross-sectional view of the adapter lid 118 with the pressure indicator 806 that includes an exertion device 810, according to an embodiment. Some of the features in FIG. 8C are the same or similar to some of the features in FIGS. 1A-1B, 2A-2D, 3A-3C, 4, 5, 6A-6B, 7A-7C, and 8A-8B as noted by the same reference numbers, unless expressly described otherwise. In one example, the adapter lid 118 may include the exertion device 810. For example, the exertion device 810 may be an elastic band, flexible band, or other device that may apply upward pressure against the opening wall 802.

In one embodiment, the exertion device 810 may be integrated into the opening wall 802 and the support wall 804. In another embodiment, the exertion device may connect the opening wall 802 to the support wall 804. In one example, when a threshold amount of vacuum pressure is applied to the adapter lid 118, the opening wall 802 may be sucked downward and the opening wall 802 may be depressed. When the opening wall 802 is in the depressed position, the exertion device 810 may be flexed downwardly as well, creating upward pressure that is lower than the amount of downward pressure. When the upward pressure created by the exertion device 810 exceed the downward pressure by the vacuum seal, the opening wall 802 may switch to the popped up position, indicating that there is not a seal between the adapter lid 118 and the container. The exertion device 810 may also provide structural support to the adapter lid 118 to reduce or eliminate a depression of the support wall 804 and other portions of the adapter lid 118 besides the opening wall 802.

FIG. 8D shows a side view of the adapter lid 118 with the pressure indicator 806 that includes and exertion device 810, according to an embodiment. Some of the features in FIG. 8D are the same or similar to some of the features in FIGS. 1A-1B, 2A-2D, 3A-3C, 4A-4B, 5, 6A-6B, 7A-7C, and 8A-8B as noted by the same reference numbers, unless expressly described otherwise. In one embodiment, the exertion device 810 may be integrated into the opening wall 802 and the support wall 804. In another embodiment, the exertion device 810 may be exposed and visible to a user. When the exertion device 810 is exposed and visible to the user, the exertion device 810 may also indicate to the user whether the opening wall 802 is in the popped up position or the depressed position. As the exertion device may exert upward pressure on the opening wall 802, the exertion device may reduce an amount of false positives from the opening wall 802 not popping up when the downward pressure is below the threshold amount.

The disclosure above encompasses multiple distinct embodiments with independent utility. While each of these embodiments has been disclosed in a particular form, the specific embodiments disclosed and illustrated above are not to be considered in a limiting sense as numerous variations are possible. The subject matter of the embodiments includes all novel and non-obvious combinations and sub-combinations of the various elements, features, functions and/or properties disclosed above and inherent to those skilled in the art pertaining to such embodiments. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and sub-combinations of the disclosed embodiments that are believed to be novel and non-obvious. Embodiments embodied in other combinations and sub-combinations of features, functions, elements and/or properties may be claimed through amendment of those claims or presentation of new claims in the present application or in a related application. Such amended or new claims, whether they are directed to the same embodiment or a different embodiment and whether they are different, broader, narrower or equal in scope to the original claims, are to be considered within the subject matter of the embodiments described herein.

The invention claimed is:

1. A container system, comprising:

a container comprising a body with a cavity to hold an object and a first opening to receive the object;

a gasket shaped to attach to a rim of the first opening of the container to form a first seal between the rim and the gasket;

an adapter lid comprising:

a second opening shaped to receive an adapter; and a first opening wall formed around at least a first portion of the first opening, the first opening wall extending from a top surface of the adapter lid;

a second opening wall formed around at least a second portion of the second opening, the second opening wall extending from a bottom surface of the adapter lid, wherein the second opening wall is tapered at an angle from the bottom surface of the adapter lid to the second opening of the adapter lid to provide structural support to the second opening; and a container band shaped to attach the gasket and the adapter lid to the rim of the container.

2. The container system of claim 1, wherein the container is a mason jar.

3. The container system of claim 1, wherein the first opening wall is tapered at another angle from the top surface of the adapter lid to the second opening of the adapter lid to form a cone shaped wall.

4. The container system of claim 1, wherein the first opening wall provides structural support to the second opening such that when the adapter is inserted into the second opening of the adapter lid, the adapter lid maintains substantially the same shape and form.

5. The container system of claim 1, wherein the container band is configured to compress the gasket and the adapter lid against the rim of the container to form a second seal between the rim, the gasket, and the adapter lid.

6. A container lid adapter, comprising:

a gasket shaped to attach to a rim of a container to form a first seal between the rim and the gasket;

an adapter lid including an opening shaped to receive an adapter, wherein the adapter lid comprises a visual indicator to indicate an integrity of a second seal between at least two of the gasket, the adapter lid, or the rim of the container; and a container band shaped to attach the gasket and the adapter lid to the rim of the container.

7. The container lid adapter of claim 6, wherein the container is a mason jar.

8. The container lid adapter of claim 6, wherein the visual indicator is a pressure seal indicator.

9. The container lid adapter of claim 6, wherein the visual indicator is integrated into the adapter lid.

10. The container lid adapter of claim 6, wherein the adapter is at least one of a bottle stopper, a liquid pourer, a wine pourer, a wine aerator, a stopper, a fermentation adapter, a one-way valve, a metered pour adapter, or a vacuum seal attachment.

11. The container lid adapter of claim 6, wherein the adapter lid further comprises one or more ribs along a top surface or a bottom surface of the adapter lid to provide structural integrity to the adapter lid.

12. The container lid adapter of claim 6, wherein the gasket, the adapter lid, and the container band are a single integrated lid shaped to connect to the container.

13. The container lid adapter of claim 6, wherein the gasket is integrate into the adapter lid.

14. A method, comprising:

placing a gasket on a rim of ajar;

placing an adapter lid on at least a portion of the gasket, wherein the adapter lid comprises:

an opening to receive an adapter;

a first opening wall formed around at least a first portion of the opening, the first opening wall extending from a top surface of the adapter lid; and a second opening wall formed around at least a second portion of the opening, the second opening wall tapering at an angle from a bottom surface of the adapter lid to the opening;

compressing the gasket and the adapter lid against the rim of the jar to form a seal between the gasket, the adapter lid, and the rim of the jar; and inserting the adapter into the opening of the adapter lid.

15. The method of claim 14, wherein the jar is a mason jar.

16. The method of claim 14, further comprising removing the adapter from the opening of the adapter lid to insert or remove an object from within the jar.

17. An apparatus, comprising:

a gasket shaped to attach to a rim of a container;

an adapter lid comprising:

an opening shaped to receive an adapter;

a first opening wall formed around at least a first portion of the opening, the first opening wall extending from a top surface of the adapter lid; and a second opening wall formed around at least a second portion of the opening, the second opening wall tapering at an angle from a bottom surface of the adapter lid to the opening; and a container band shaped to attach the gasket and the adapter lid to the rim of the container.

18. The apparatus of claim 17, wherein the gasket, the adapter lid, and the container band are a single integrated lid shaped to connect to the container.

19. The apparatus of claim 17, wherein the second opening wall is a mirror image of the first opening wall.

20. The apparatus of claim 17, wherein the adapter lid is reversible such that the top surface of the adapter lid becomes the top surface of the adapter lid and the bottom surface of the adapter lid becomes the top surface of the adapter lid.

21. The container system of claim 1, wherein the adapter lid is reversible such that the top surface of the adapter lid becomes the top surface of the adapter lid and the bottom surface of the adapter lid becomes the top surface of the adapter lid.

* * * * *